US005587270A

United States Patent [19]

Janssens et al.

[11] Patent Number: 5,587,270

[45] Date of Patent: *Dec. 24, 1996

[54] THERMAL IMAGING PROCESS AND AN ASSEMBLAGE OF A DONOR AND RECEIVING ELEMENT FOR USE THEREIN

[75] Inventors: Wilhelmus Janssens, Aarschot; Jan Van den Bogaert, Schilde; Luc Vanmaele, Lochristi; Geert Defieuw, Kessel-Lo, all of Belgium

[73] Assignee: Agfa-Gevaert N.V., Mortsel, Belgium

[ * ] Notice: The term of this patent shall not extend beyond the expiration date of Pat. No. 5,589,317.

[21] Appl. No.: 400,349

[22] Filed: Mar. 8, 1995

[30] Foreign Application Priority Data

Mar. 10, 1994 [EP] European Pat. Off. ..... 94200613.1

[51] Int. Cl.[6] ..... G03C 8/40; G03C 8/18

[52] U.S. Cl. ..... 430/203; 430/243; 430/617

[58] Field of Search ..... 430/336–348, 430/351, 243, 617, 3, 22, 200, 201, 256, 257, 203

[56] References Cited

U.S. PATENT DOCUMENTS

| | | | |
|---|---|---|---|
| 3,218,166 | 11/1965 | Reitter . | |
| 3,767,414 | 10/1973 | Huffman et al. | 96/114 |
| 4,374,921 | 2/1983 | Frenchik | 430/338 |
| 5,028,523 | 7/1991 | Skoug | 430/617 |
| 5,380,607 | 1/1995 | Van Haute et al. | 430/3 |
| 5,384,238 | 1/1995 | Ellis et al. | 430/617 |

FOREIGN PATENT DOCUMENTS

| | | |
|---|---|---|
| 246832 | 9/1962 | Australia . |
| 0512477 | 11/1992 | European Pat. Off. . |
| 0533008 | 3/1993 | European Pat. Off. . |

*Primary Examiner*—Thorl Chea
*Attorney, Agent, or Firm*—Brumbaugh, Graves, Donohue & Raymond

[57] ABSTRACT

The present invention concerns a thermal imaging process using (i) a donor element comprising on a support a donor layer comprising a binder and a thermally transferable reducing agent capable of reducing a silver source to metallic silver upon heating and an oxidised form of the reducing agent being colored or being capable of forming a color and (ii) a receiving element comprising on a support a receiving layer comprising a silver source capable of being reduced by means of heat in the presence of a reducing agent and comprising the steps of:

bringing said donor layer of the donor element in face-to-face relationship with the receiving layer of the receiving element, image-wise heating a thus obtained assemblage to cause image-wise transfer of the thermally transferable reducing agent from the donor layer to the receiving layer in accordance with the amount of heat applied and separating the donor element from the receiving element.

6 Claims, No Drawings

THERMAL IMAGING PROCESS AND AN ASSEMBLAGE OF A DONOR AND RECEIVING ELEMENT FOR USE THEREIN

DESCRIPTION

1. Field of the Invention

The present invention relates to a recording material suited for use in thermal imaging. More in particular the present invention relates to a recording material based on a heat induced reaction between a thermo-reducible silver source, e.g. a substantially light insensitive organic silver salt, in a receiving layer and a color forming reducing agent, transferred image-wise from a donor element by means of image-wise heating with e.g. a thermal head.

2. Background of the Invention

Thermal imaging or thermography is a recording process wherein images are generated by the use of image-wise modulated thermal energy.

In thermography two approaches are known:

1. Direct thermal formation of a visible image pattern by image-wise heating of a recording material containing matter that by chemical or physical process changes colour or optical density.

2. Formation of a visible image pattern by transfer of a coloured species from an image-wise heated donor element onto a receptor element.

A survey of "direct thermal" imaging methods is given in the book "Imaging Systems" by Kurt I. Jacobson-Ralph E. Jacobson. The Focal Press—London and New York (1976), Chapter VII under the heading "7.1 Thermography". Thermography is concerned with materials which are not photosensitive, but are heat sensitive. Image-wise applied heat is sufficient to bring about a visible change in a thermosensitive imaging material.

According to a direct thermal embodiment operating by physical change a recording material is used which contains a coloured support or support coated with a coloured layer which itself is overcoated with an opaque white light reflecting layer that can fuse to a clear, transparent state whereby the coloured support is no longer masked. Physical thermographic systems operating with such kind of recording material are described on pages 136 and 137 of the above mentioned book of Kurt I. Jacobson et al.

Yet most of the "direct" thermographic recording materials are of the chemical type. On heating to a certain conversion temperature, an irreversible chemical reaction takes place and a coloured image is produced.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

According to one embodiment dye images are produced by thermal-ink transfer printing by selectively energizing the electrical resistors of a thermal head array in contact with a thin thermally stable resin base, which contains on its opposite side a so-called ink-layer from which a dye can be thermally transferred onto a receptor material.

According to another embodiment known as resistive ribbon non-impact printing [ref. e.g. Progress in Basic Principles of Imaging Systems—Proceedings of the International Congress of Photographic Science Köln (Cologne), 1986, editors: Friedrich Granzer and Erik Moisar, Friedr. Vieweg & Sohn—Braunschweig/Wiesbaden Journal of Imaging Technology, Vol. 12, No. 2, April 1986, p. 100–110 and Journal of Imaging Science—Volume 33, No. 1, January/February 1989, p. 7] from an electrode-array electrical current is sent pixelwise into a resistive ribbon coated at the other side with a thermally transferable dye.

According to a more recently disclosed technique, see e.g. U.S. Pat. No. 4,908,631, an ultrasonic pixel printer is used for applying the necessary thermal energy to a dye donor layer to cause the dye to melt and/or sublime and transfer to a receiver element.

Thermal dye transfer processes are intended mainly for multicolour dye image reproduction but are also suited for the production of monochrome images including black images, which means that black-and-white and/or colour prints can be made by printing with an adapted dye-donor element.

Direct thermal imaging and thermal dye transfer can be used for both the production of reflection type prints (having an opaque white light reflecting background) and transparencies. In the medical diagnostic field black-and-white or monochrome transparencies find wide application in inspection techniques operating with a light box.

For the production of black-and-white prints use is made of dye-donor elements having a black dye area. Instead of a black dye a mixture of dyes can also be employed, which mixture is then chosen such that a neutral black transfer image is obtained. It is of course also possible to produce a black image by printing from several dye areas one dye over the other and in register. However, this procedure is less suitable because it is more time-consuming and needs a higher length of donor element.

The optical density of transparencies produced by thermal transfer procedure is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field a maximal transmission density of at least 2.5 is desired.

EP-A-537.975 discloses a thermographic system comprising on a support an image forming layer containing an organic silver salt and a reducing agent. The material is image-wise heated by means of a thermal head to obtain a silver image of high density.

Such a thermographic system has the disadvantage that in the non-image places the co-reactants remain unchanged, impairing the shelf-life and preservability. Moreover, due to the extreme high density which is needed on film for medical purposes, controlling and lowering the gradation to the specific needs requested for special medical diagnostic applications is very difficult to realise in a reproducible manner.

It would be desirable to provide a thermographic system according to which the high optical density combined with low or soft gradation is obtained by a thermal transfer process. It is furthermore desirable to obtain black images having a neutral tone.

OBJECT AND SUMMARY OF THE INVENTION

It is an object of the present invention to provide a thermal imaging process yielding images of high density and neutral black tone and that is capable of yielding images with multiple intermediate density levels i.e. having a soft gradation.

Other objects and advantages of the present invention will appear from the further description and examples.

In accordance with the present invention a thermal imaging process is provided using (i) a donor element comprising on a support a donor layer comprising a binder and a thermally transferable reducing agent capable of reducing a silver source to metallic silver upon heating and an oxidised form of said reducing agent being colored or being capable of forming a color and (ii) a receiving element comprising on a support a receiving layer comprising a silver source capable of being reduced by means of heat in the presence of a reducing agent and comprising the steps of:

bringing said donor layer of said donor element in face-to-face relationship with said receiving layer of said receiving element, image-wise heating a thus obtained assemblage to cause image-wise transfer of said thermally transferable reducing agent from said donor layer to said receiving layer in accordance with the amount of heat applied and separating said donor element from said receiving element.

The present invention further provides an assemblage consisting of a donor element and a receiving element for use in combination with said donor element, said donor element comprising on a support a donor layer comprising a binder and a thermally transferable reducing agent capable of reducing a silver source to metallic silver upon heating and an oxidised form of said reducing agent being colored or being capable of forming a color and said receiving element comprising on a support a receiving layer comprising a silver source capable of being reduced by means of heat in the presence of a reducing agent.

DETAILED DESCRIPTION OF THE INVENTION

For sake of convenience the thermally transferable reducing agent capable of reducing a silver source to metallic silver upon heating and an oxidised form of said reducing agent being colored or being capable of forming a color will be referred to by the term color forming reducing agent.

In the preferred embodiment of the method according to the present invention the image-wise transfer of the color forming reducing agent onto the receptor element (sheet, ribbon or web) proceeds by Joule effect heating in that selectively energized electrical resistors of a thermal head array are used in contact with a thin thermally stable resin base of a donor element (sheet, ribbon or web optionally coated at its rear side with a heat-resistant layer) whereon The color forming reducing agent is present in a donor layer. The receptor element being held in contact with the donor layer receives image-wise an amount of color forming reducing agent in accordance with the amount of heat applied.

The thermal energy further causes an oxido-reduction reaction between the color forming reducing agent and the silver source. As a consequence the silver source is reduced to metallic silver and the reducing is being oxidised to one or more of its oxidised states. In accordance with the present invention, at least one of these oxidised states is either colored or forms a color upon reaction with a co-reactant e.g. the reducing agent itself or an oxidised form thereof.

The thus formed color adds optical density to the optical density of the metallic silver image and compensates the hue of the metallic image so as to obtain neutral grays and blacks, as needed for medical diagnostic purposes. Furthermore, since the amount of color forming reducing agent being reduced can be adjusted by controlling the amount of image-wise heating a soft gradation can be obtained.

Thermal printing heads that can be used to transfer color forming reducing agent from donor elements to a receiving sheet according to the present invention are commercially available. Suitable thermal printing heads are e.g. a Fujitsu Thermal Head (FTP-040 MCS001), a TDK Thermal Head F415 HH7-1089, and a Rohm Thermal Head KE 2008-F3 and Kyocera Thermal Head KST-219-12-12MPG 27.

For forming black images the color of the oxidation product of the color forming reducing agent or reactions products thereof and the color of the metallic image formed by heat may be complementary, e.g. are blue and yellow respectively.

Although in accordance with the above preferred embodiment, image-wise heating is accomplished by means of a thermal head, other image-wise heating sources well-known to those skilled in the art can be used.

After the transfer of the color forming reducing agent by image-wise heating in accordance with the present invention, the receiving layer may undergo an additionally heating in order to increase the maximum density and to improve the hue of the formed metallic silver image.

The additionally heating may be in the period from 1 to 60 seconds at 100° to 140° C. e.g. 3 seconds at 120° C.

Receiving Element

As a reactant in the receiving layer for forming a metallic image a thermally reducible source of silver is used. An especially preferred thermally reducible source of silver is a substantially light-insensitive organic silver salt.

Substantially light-insensitive organic silver salts particularly suited for use according to the present invention are silver salts of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate, and likewise silver dodecyl sulphonate described in U.S. Pat. No. 4,504,575 and silver di(2-ethylhexyl)-sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677. Other useful reducible silver sources are described in EP-A-537.975. The most preferred reducible silver source is silver behenate.

As binding agent for the receiving layer of the receiving element preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image receiving layer is preferably in the range of 5 to 16 μm.

Donor Element

Examples of color forming reducing agents of which an oxidised form reacts to form a color are auto-coupling substances such as 4-methoxy, 1-naftol and indoxyl, and auto-coupling aminophenols, as described in "Chimie photographique" of P. Glafkidés 2th edition p. 604.

Color forming reducing agents having colored oxidation products are e.g. bisphenols such as described in EP-A-509740.

Highly preferred color forming reducing agents are reduced forms of indoaniline or azomethine dyes i.e. leuco-indoanilines or leuco-azomethine dyes. Particularly preferred are leuco-indoanilines corresponding to the following general formula I:

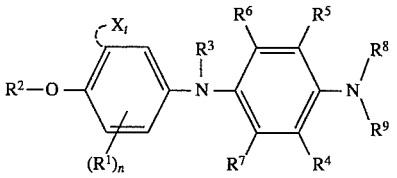

wherein:

$R^1$ represents hydrogen or any substituent, n is zero or a positive integer chosen from 1 to 4, and when n is 2, 3, or 4, $R^1$ has same or different significance, each of $R^2$ and $R^3$ independently represents hydrogen or an acyl group chosen from the group of —$COR^{10}$, —$SO_2R^{10}$, and —$OPR^{10}R^{11}$, X represents the atoms needed to complete a fused-on ring, t is 0 or 1, each of $R^4$, $R^5$, $R^6$ and $R^7$ independently represents hydrogen, an alkyl group, a cycloalkyl group, an aryl group, an alkyloxy group, an aryloxy group, a carbamoyl group, a sulphamoyl group, a hydroxy, a halogen atom, —NH—$SO_2R^{12}$, —NH—$COR^{12}$, —O—$SO_2R^{12}$, or —O—$COR^{12}$, or $R^4$ and $R^7$ together or $R^5$ and $R^6$ together represent the atoms necessary to complete an aliphatic ring or a heterocyclic ring, or $R^4$ and $R^8$ or $R^5$ and $R^9$ together represent the atoms necessary to complete a heterocyclic ring, each of $R^8$ and $R^9$ independently represents hydrogen, an alkyl group, a cycloalkyl group, an aryl group, a heterocyclic ring or $R^8$ and $R^9$ together represent the atoms necessary to complete a heterocyclic ring, each of $R^{10}$, $R^{11}$, and $R^{12}$ independently represents an alkyl group, a cycloalkyl group, an aryl group, an alkyloxy group, an aryloxy group, an alkylthio group, an arylthio, an amino group or a heterocyclic ring.

A non-exhaustive list of leuco-indoanilines corresponding to the general formula I is given in Table 1 hereinafter.

TABLE 1

L1

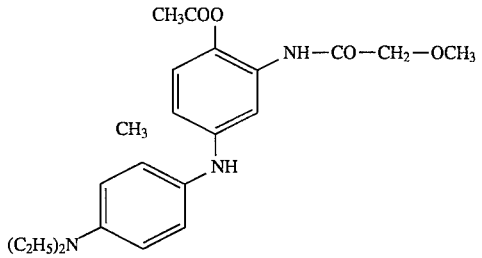

L2

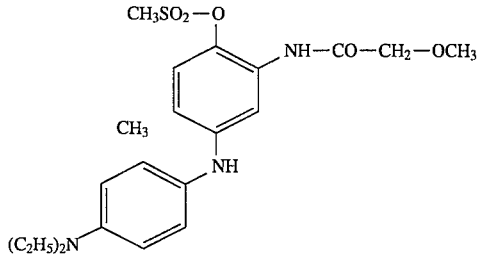

L3

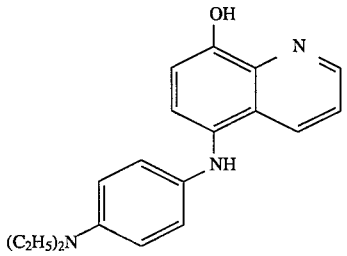

L4

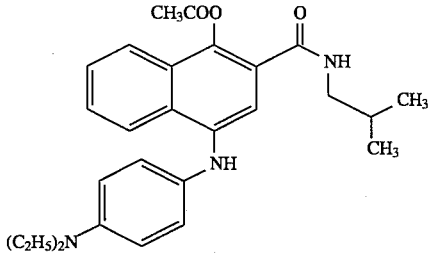

L5

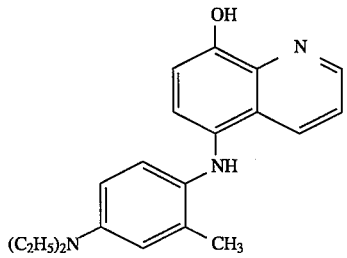

TABLE 1-continued
L6
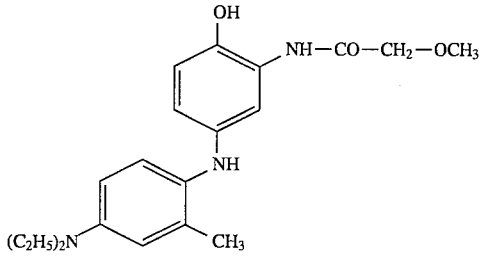
L7
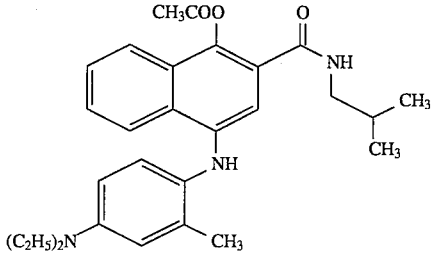
L8
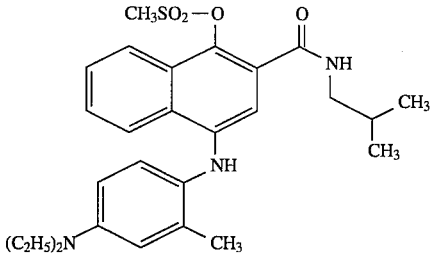
L9
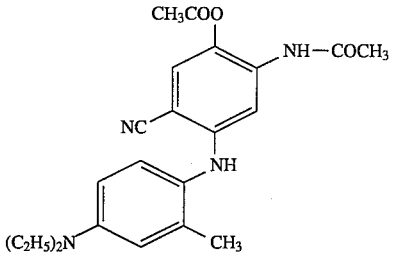
L10
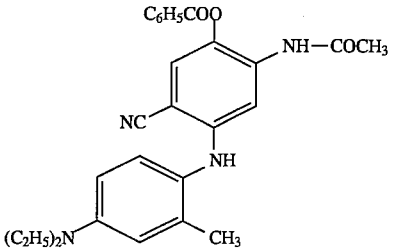
L11
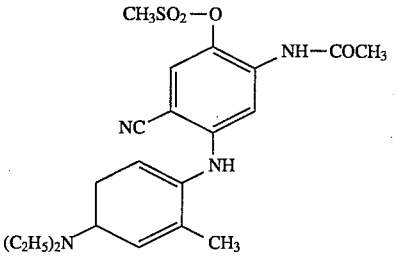
TABLE 1-continued
L12
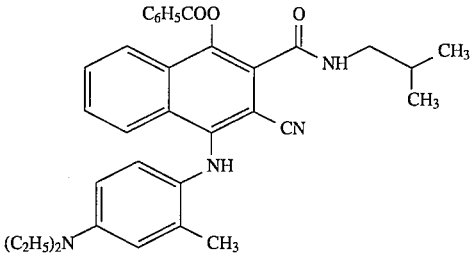
L13
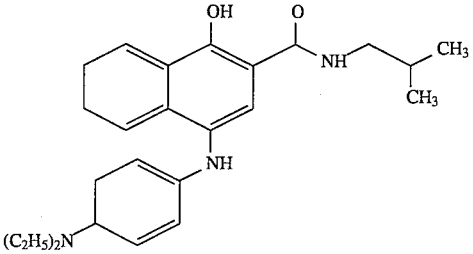
L14
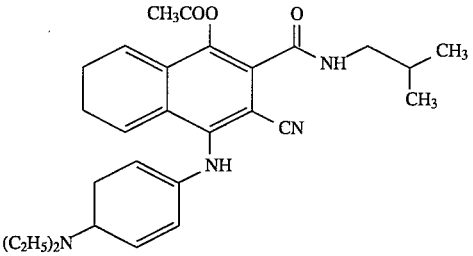
L15
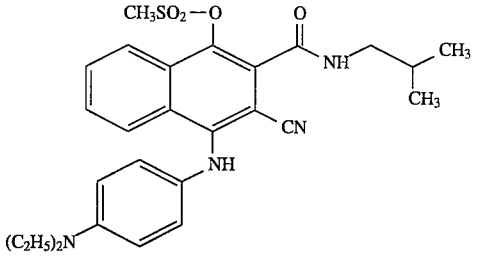
L16
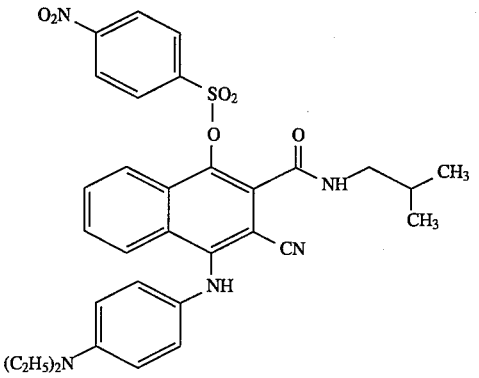

TABLE 1-continued

| | |
|---|---|
| 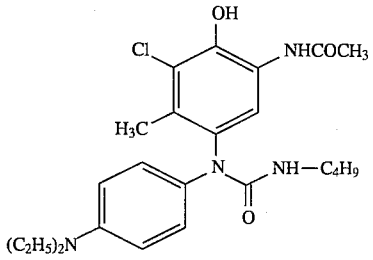 | L17 |

The compounds corresponding to the above general formula can be prepared by reducing the corresponding dye and, if necessary, derivatizing the leuco dye with acyl chlorides.

Other preferred forms of leuco-azomethines are described in RD 22623 (February 1983), EP 0533 008, EP 512 477, RD 21003 (October 1981) and EP 0069 585.

The donor layer containing the color forming reducing agent of the donor element is formed preferably by adding the reducing agent, a polymeric binder medium and other optional components to a suitable solvent or solvent mixture, dissolving or dispersing by ball-milling these ingredients to form a coating composition that is applied to a support, which may have been provided first with an adhesive or subbing layer, and dried.

The donor layer thus formed has a thickness of about 0.2 to 5.0 μm, preferably 0.4 to 2.0 μm, and the amount ratio of color forming reducing agent to binder ranges from 9:1 to 1:3 by weight, preferably from 2:1 to 1:2 by weight.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic. Preferably, the binder for the donor layer in accordance with the present invention comprises cellulose acetate butyrate or poly(styrene-co-acrylonitrile).

The donor layer may also contain other additives, such as curing agents, preservatives, dispersing agents, antistatic agents, defoaming agents, viscosity-controlling agents.

Any material can be used as the support for the donor element provided it is dimensionally stable and capable of withstanding the temperatures involved, up to 400° C. over a period of up to 20 msec, and is yet thin enough to transmit heat applied on one side through to the reducing agent on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condensor paper. Preference is given to a support comprising polyethylene terephthalate. In general, the support has a thickness of 2 to 30 μm, preferably a thickness of 2 to 10 μm. The support may also be coated with an adhesive of subbing layer, if desired.

The donor layer of the donor element can be coated on the support or printed thereon by a printing technique such as a gravure process.

A barrier layer comprising a hydrophilic polymer may also be employed between the support and the donor layer of the donor element to enhance the transfer efficiency of the color forming reducing agent by preventing wrong-way transfer of color forming reducing agent backwards to the support. The barrier layer may contain any hydrophilic material that is useful for the intended purpose. In general, good results can been obtained with gelatin, polyacrylamide, polyisopropyl acrylamide, butyl methacrylate-grafted gelatin, ethyl methacrylate-grafted gelatine, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable barrier layers have been described in e.g. EP 227,091 and EP 228,065. Certain hydrophilic polymers e.g. those described in EP 227,091 also have an adequate adhesion to the support and the donor layer, so that the need for a separate adhesive or subbing layer is avoided. These particular hydrophilic polymers used in a single layer in the donor element thus perform a dual function, hence are referred to as barrier/subbing layers.

Preferably the reverse side of the donor element has been coated with a slipping layer to prevent the printing head from sticking to the donor element. Such a slipping layer would comprise a lubricating material such as a surface-active agent, a liquid lubricant, a solid lubricant or mixture thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$-$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP 138,483, EP 227,090, U.S. Pat. No. 567,113, U.S. Pat. No. 572,860, U.S. Pat. No. 717,711. Preferably the slipping layer comprises a styrene-acrylonitrile copolymer or a styrene-acrylonitrile-butadiene copolymer or a mixture thereof or a polycarbonate as described in European patent application no. 91202071.6, as binder and a polysiloxane-polyether copolymer or polytetrafluoroethylene or a mixture thereof as lubricant in an amount of 0.1 to 10% by weight of the binder or binder mixture.

The support for the receiver sheet that is used with the donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

The donor layer of the donor element or the image-receiving layer of the receiver sheet may also contain a releasing agent that aids in separating the donor element from the receiver sheet after transfer. The releasing agents can also be incorporated in a separate layer on at least part of the donor layer and/or of the image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The following examples illustrate the invention in more detail without, however, limiting the scope thereof. All parts are by weight unless otherwise specified.

EXAMPLES

Preparation of the Receiving Material

A subbed polyethylene terephthalate support having a thickness of 100 μm was doctor blade-coated so as to obtain thereon after drying the following layer including:

| | |
|---|---|
| silver behenate | 4.5 g/m$^2$ |
| 3,4-dihydro-2,4-dioxo-1,3,2H-benzoxazine | 0.34 g/m$^2$ |
| polyvinyl butyral (Butbar B79 - Monsanto) | 4.5 g/m$^2$ |
| Baysilone Öl (tradename Bayer AG) | 0.017 g/m$^2$ |

After drying on this layer was coated a releasing agent from hexane:

| | |
|---|---|
| Tegoglide 410* | 0.03 g/m$^2$ |

*Tegoglide 410 (tradename) is a lubricant of the polysiloxanepolyether type.

The so obtained material is used as receiving element in the further examples.

Preparation of the Donor Elements

Donor elements for use according to the present invention were prepared as follows:

A solution comprising an amount of reducing agent or comparison compound as indicated in the following Tables 2, 4 and 6 and an amount of binder also indicated in the Tables in ethyl methyl ketone was prepared.

From this solution a donor layer having a wet thickness of 100 μm was coated on a polyethylene terephthalate film support having a thickness of 6 μm and carrying a conventional subbing layer. The resulting donor layer was dried by evaporation of the solvent.

The opposite side of the film support was coated with a subbing layer of a copolyester comprising ethylene glycol, adipic acid, neopentyl glycol, terephthalate acid, isophthalic acid, and glycerol.

The resulting subbing layer was covered with a solution in methyl ethyl ketone of 13% of a polycarbonate having the following structural formula (III):

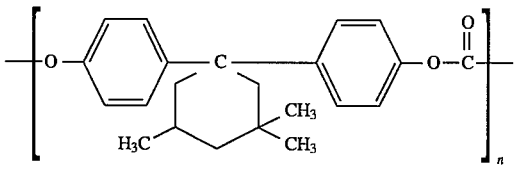

wherein n represents the number of units to obtain a polycarbonate having a relative viscosity of 1.30 as measured in a 0.5% solution in dichloromethane, 0.5% of talc (Nippon Talc P3, Interorgana) and 0.5% of zinc stearate.

Finally, a top layer of polyether-modified polydimethylsiloxane (Tegoglide 410, Goldschmidt) was coated from a solution in isopropanol on the resulting heat-resistant polycarbonate layer.

The donor element was printed in combination with the receiver sheet in a Mitsubishi colour video printer CP100E.

The receiver sheet was separated from the donor element and the maximum density value of the recorded image was measured by means of a Macbeth TR 924 densitometer in the red, green, blue and visual region in Status A mode.

The above described experiment was repeated for conventional silver salt developers given in Example 1 as comparison, for the leuco reducing agents according to the invention in Example 2 and for some colour dyes from which the leuco reducing agents can be derived, given in Example 3 as a comparison.

EXAMPLE 1

Comparison

The chemical structure of the conventional photographic developers used as reducing agent for the silver source are given in Table 3 hereinafter.

The obtained densities are given in Table 2.

The experiments show That the colour of the developed silver image is brown-yellow to brown-red and not at all neutral gray or black.

The same can be seen by comparison of the densities behind the absorption filters red and blue, where the values for the blue filter are more than the double of those for the red filter.

The obtained silver image are unsuitable for use in medical diagnostic systems.

TABLE 2

| Sample | Reducing Agent No. | Reducing Agent Amount (%) | Binder* No. | Binder* Amount (%) | Density after printing Red | Green | Blue | Vis. |
|---|---|---|---|---|---|---|---|---|
| 1 | R1 | 0.5% | 1 | 0.2% | 82 | 159 | 237 | 120 |
| 2 | R2 | 0.5% | 1 | 0.2% | 57 | 123 | 206 | 89 |
| 3 | R3 | 0.5% | 2 | 0.5% | 100 | 231 | 324 | 152 |
| 4 | R3 | 1.1% | 2 | 0.5% | 99 | 246 | 393 | 153 |
| 5 | R3 | 0.5% | 1 | 0.5% | 77 | 191 | 340 | 123 |
| 6 | R3 | 1.1% | 1 | 0.5% | 101 | 239 | 384 | 153 |
| 7 | R4 | 1.1% | 2 | 0.5% | 81 | 106 | 120 | 96 |
| 8 | R5 | 1.1% | 2 | 0.5% | 56 | 148 | 338 | 95 |

| Sample | Density after additional heating at 140° C. Red | Green | Blue | Vis. |
|---|---|---|---|---|
| 1 | 75 | 143 | 191 | 110 |
| 2 | 47 | 125 | 226 | 83 |
| 3 | 154 | 293 | 318 | 211 |
| 4 | 159 | 332 | 484 | 217 |
| 5 | 132 | 292 | 454 | 189 |
| 6 | 176 | 338 | 404 | 235 |
| 7 | 144 | 190 | 278 | 171 |
| 8 | 216 | 363 | 401 | 272 |

*: Binder 1: Nitrocellulose
Binder 2: Copolystyrene-acrylonitrile (Luran 388S - BASF)

The additional heating time for samples 1, 2 and 8 was 5 min, and 1 min. for the other samples.

TABLE 3

R1

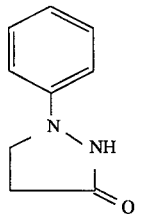

R2

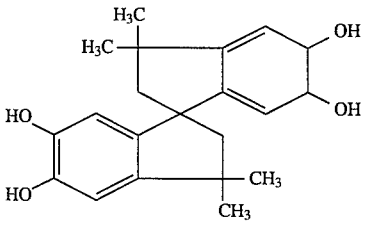

3,4,5-tri-hydroxy-ethylbenzoate

R3

R4

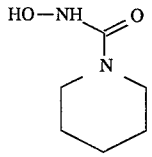

TABLE 3-continued

R5

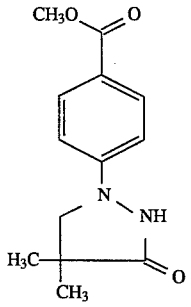

EXAMPLE 2

Leuco-reducing Agents According to the Invention

The chemical structure of the leuco-reducing agents used as developers for the silver source and forming a colour dye after oxidation are given in Table 1 above except for L18 which is 4-methoxynaphtol.

The obtained densities are given in Table 4.

From the experiments it can be seen that the colour of some of the developed silver images is from neutral black to bluish-black or green-black.

The same can be seen by comparison of the densities behind the absorption filters red and blue, where the values this time, compared to Example 1 are more equal with higher red values.

Due to the more equal values behind the 3 absorption filters (red, green, blue), the densities behind the visual filter are also larger as compared to Example 1.

In some experiments the color of the obtained silver image is suited for use in medical diagnostic systems.

TABLE 4

| Color forming reducing agent | | Binder* Am. | Density after printing | | | | Density after additional heating at 140° C.*** | | | |
|---|---|---|---|---|---|---|---|---|---|---|
| No | Am. (%) | (%) | Red | Green | Blue | Vis | Red | Green | Blue | Vis |
| L6 | 0.5% | 0.2% | 348 | 158 | 193 | 187 | 422 | 465 | 427 | 422 |
| L6 | 1.1% | 0.5% | 0485 | 227 | 227 | 255 | 530 | 477 | 428 | 482 |
| L1 | 1.1% | 0.5% | 97 | 101 | 147 | 94 | 305 | 387 | 383 | 349 |
| L2 | 1.1% | 0.5% | 19 | 56 | 99 | 44 | 192 | 275 | 271 | 233 |
| L10 | 1.1% | 0.5% | 22 | 27 | 44 | 24 | 190 | 273 | 261 | 230 |
| L3 | 0.5% | 0.2% | 214 | 94 | 206 | 118 | 65 | 104 | 177 | 83 |
| L5 | 0.5% | 0.2% | 210 | 79 | 224 | 101 | 201 | 139 | 232 | 146 |
| L17 | 1.1% | 0.5% | 66 | 45 | 53 | 52 | 302 | 171 | 137 | 194 |
| L18 | 1.1% | 0.5% | 331 | 309 | 305 | 310 | 356 | 440 | 433 | 398 |

*: The binder used was Nitrocelluose
L17 was ball-milled because of the poor solubility
***: The additional heating time was 5 min.

EXAMPLE 3

Comparison

In this example indoaniline dyes D1 and D2 are used for comparison.

From Dye D1, the color forming reducing agents L6, L2 and L1 are derived.

D1

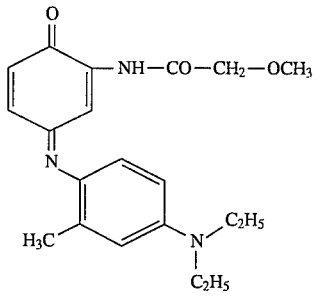

D2

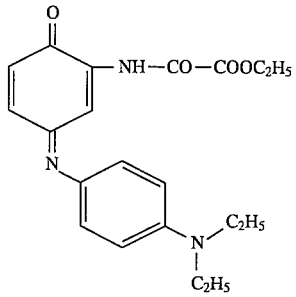

The obtained densities are given in Table 5. The donor element was prepared as described above using a coating solution for the donor layer containing 0.5% by weight of nitrocellulose and 1.1.% by weight of dye D1 or D2.

TABLE 5

| | Density after printing | | | | Density after additional heating at 140° C. for 5 min. | | | |
|---|---|---|---|---|---|---|---|---|
| Dye | Red | Green | Blue | Vis | Red | Green | Blue | Vis. |
| D1 | 386 | 72 | 32 | 97 | 442 | 107 | 65 | 132 |
| D2 | 307 | 55 | 18 | 81 | 361 | 69 | 28 | 95 |

Comparing the results of D1 with those of L6 from Table 4 it is clear that no silver image is built-up by using the indoaniline dyes instead of the leuco-indoaniline derived therefrom. This results in the low values behind the blue filter.

We claim:

1. A thermal imaging process comprising, in order, the steps of:

a) bringing a donor layer of a donor element into face to face relationship with a receiving layer of a receiving element to obtain an assemblage, b) imaging-wise heating the assemblage, thereby causing image-wise transfer of an amount of said thermally transferrable reducing agent from said donor layer to said receiving layer in accordance with an amount of heat supplied during the image-wise heating, c) separating said donor element from said receiving element, and d) overall heating said receiving element, wherein (i) said donor element comprises said donor layer on a support, wherein said donor layer comprises a binder and said thermally transferrable reducing agent which is capable of reducing a silver source to metallic silver upon heating, and wherein an oxidized form of said reducing agent is colored or capable of forming a color, and (ii) said receiving element comprises said receiving layer on a support, said receiving layer comprising a silver source which is capable of being reduced by means of heat in the presence of a reducing agent.

2. A thermal imaging process according to claim 1 wherein said thermally transferable reducing agent is a leuco-azomethine dye or leuco-indoaniline dye.

3. A thermal imaging process according to claim 2 wherein said leuco-indoaniline dye corresponds to the following formula:

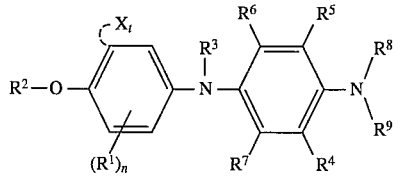

wherein:

$R^1$ represents hydrogen or a substituent, n is zero or a positive integer chosen from 1 to 4, and when n is 2, 3, or 4, $R^1$ has same or different significance, each of $R^2$ and $R^3$ independently represents hydrogen or an acyl group chosen from the group of $—COR^{10}$, $—SO_2R^{10}$, and $—OPR^{10}R^{11}$, X represents the atoms needed to complete a fused-on ring, t is 0 or 1, each of $R^4$, $R^5$, $R^6$, and $R^7$ independently represents hydrogen, an alkyl group, a cycloalkyl group, an aryl group, an alkyloxy group, an aryloxy group, a carbamoyl group, a sulphamoyl group, a hydroxy, a halogen atom, $—NH—SO_2R^{12}$, $—NH—COR^{12}$, $—O—SO_2R^{12}$, or $—O—COR^{12}$, or $R^4$ and $R^7$ together or $R^5$ and $R^6$ together represent the atoms necessary to complete an aliphatic ring or a heterocyclic ring, or $R^4$ and $R^8$ or $R^5$ and $R^9$ together represent the atoms necessary to complete a heterocyclic ring, each of $R^8$ and $R^9$ independently represents hydrogen, an alkyl group, a cycloalkyl group, an aryl group, a heterocyclic ring or $R^8$ and $R^9$ together represent the atoms necessary to complete a heterocyclic ring, each of $R^{10}$, $R^{11}$, and $R^{12}$ independently represents an alkyl group, a cycloalkyl group, an aryl group, an alkyloxy group, an aryloxy group, an alkylthio group, an arylthio, an amino group or a heterocyclic ring.

4. A thermal imaging process according to claim 1 wherein said silver source is a substantially light insensitive organic silver salt.

5. A thermal imaging process according to claim 1 wherein said image-wise heating is carried out by means of a thermal head.

6. A thermal imaging process according to claim 1 wherein said oxidized form of said reducing agent has a blue color.

* * * * *

UNITED STATES PATENT AND TRADEMARK OFFICE

CERTIFICATE OF CORRECTION

PATENT NO. : 5,587,270

DATED : December 24, 1996

INVENTOR(S) : Janssens et al.

It is certified that error appears in the above-indentified patent and that said Letters Patent is hereby corrected as shown below:

On the title page, item [*]; "Pat. No. 5,589,317" should read --Pat. Nos. 5,601,962; 5,589,317; 5,587,269; 5,587,268; 5,595,854; 5,547,809 and the patent issuing from Application Serial No. 08/618,399 filed March 19, 1996--;

Column 10, line 44, "567,113" should read --4,567,113--;

Column 10, line 45, "572,860, U.S. Pat. No. 717,711" should read --4,572,860, U.S. Pat. No. 4,717,711--.

Signed and Sealed this

Twelfth Day of August, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,587,270

DATED : December 24, 1996

INVENTOR(S) : Janssens et al.

It is certified that error appears in the above-identified patent and that said Letters Patent is hereby corrected as shown below:

Column 5, line 30, that portion of Formula I reading:

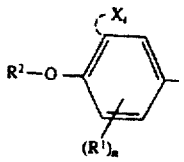

should read:

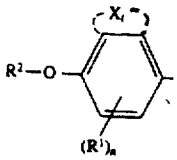

UNITED STATES PATENT AND TRADEMARK OFFICE

CERTIFICATE OF CORRECTION

PATENT NO. : 5,587,270

DATED : December 24, 1996

INVENTOR(S) : Janssens et al.

It is certified that error appears in the above-identified patent and that said Letters Patent is hereby corrected as shown below:

Column 16, line 15, that portion of the formula in Claim 9 reading:

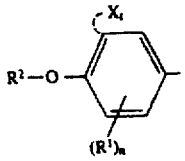

should read:

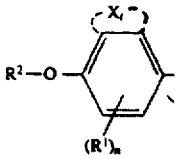

Signed and Sealed this

Twenty-first Day of October 1997

*Attest:*

*Attesting Officer*

BRUCE LEHMAN

*Commissioner of Patents and Trademarks*